US008648537B2

(12) United States Patent
Chu

(10) Patent No.: US 8,648,537 B2
(45) Date of Patent: Feb. 11, 2014

(54) METHODS AND APPARATUS FOR DRIVING LED-BASED LIGHTING UNITS

(75) Inventor: Hung-Chi Chu, Kaohsiung (TW)

(73) Assignee: VastView Technology Inc., Hsinchu County (TW)

( * ) Notice: Subject to any disclaimer, the term of this patent is extended or adjusted under 35 U.S.C. 154(b) by 154 days.

(21) Appl. No.: 13/420,608

(22) Filed: Mar. 15, 2012

(65) Prior Publication Data

US 2013/0241423 A1 Sep. 19, 2013

(51) Int. Cl.
*H05B 37/02* (2006.01)

(52) U.S. Cl.
USPC ..... 315/121; 315/122; 315/191; 315/193

(58) Field of Classification Search
USPC ..... 326/122, 121, 187, 191, 193, 291
See application file for complete search history.

(56) References Cited

U.S. PATENT DOCUMENTS

| | | | | |
|---|---|---|---|---|
| 6,777,891 | B2 | 8/2004 | Lys et al. | |
| 6,989,807 | B2 * | 1/2006 | Chiang | 345/82 |
| 7,468,723 | B1 * | 12/2008 | Collins | 345/102 |
| 7,781,979 | B2 | 8/2010 | Lys | |
| 7,986,107 | B2 * | 7/2011 | Weaver et al. | 315/291 |
| 8,410,717 | B2 * | 4/2013 | Shteynberg et al. | 315/291 |
| 2008/0068298 | A1 | 3/2008 | Shen et al. | |

* cited by examiner

*Primary Examiner* — Vibol Tan

(57) ABSTRACT

A plurality of switching units interleaves with a plurality of LED-based lighting units to configure the interconnection of the LED-based lighting units for providing multiple lighting modes. Each switching unit disposed between a leading lighting unit and a trailing lighting unit is separately controlled by a controller. The switching unit can be configured to connect the two LED-based lighting units in parallel or in series, or to bypass the leading LED-based lighting unit. All the LED-based lighting units are connected in series when an input voltage supply is at a maximum voltage level, and connected in parallel when the input voltage supply is at a minimum voltage level. As the input voltage level decreases, the number of LED-based lighting units connected in parallel increases, and vice versa.

17 Claims, 15 Drawing Sheets

METHODS AND APPARATUS FOR DRIVING LED-BASED LIGHTING UNITS

BACKGROUND OF THE INVENTION

1. Field of the Invention

The present invention relates generally to LED-based lighting units, and more particularly to methods and apparatus for driving a plurality of LED-based lighting units in a combination of series or parallel connection.

2. Description of Related Arts

Light emitting diodes (LEDs) are semiconductor-based light sources often employed in low-power instrumentation and appliance applications for indication purposes. The application of LEDs in various lighting units has become more and more popular. For example, high brightness LEDs have been widely used for traffic lights, vehicle indicating lights, and braking lights.

An LED has an I-V characteristic curve similar to an ordinary diode. When the voltage applied to the LED is less than a forward voltage, only very small current flows through the LED. When the voltage exceeds the forward voltage, the current increases sharply. The output luminous intensity of an LED light is approximately proportional to the LED current for most operating values of the LED current except for the high current value. A typical driving device for an LED light is designed to provide a constant current for stabilizing light emitted from the LED and extending the life of the LED.

In order to increase the brightness of an LED light, a number of LEDs are usually connected in series to form an LED-based lighting unit and a number of LED-based lighting units may further be connected in series to form a lighting apparatus. For example, U.S. Pat. No. 6,777,891 discloses a plurality of LED-based lighting units as a computer-controllable light string with each lighting unit forming an individually-controllable node of the light string.

The operating voltage required by each lighting unit typically is related to the forward voltage of the LEDs in each lighting unit, how many LEDs are employed for each of the lighting unit and how they are interconnected, and how the respective lighting units are organized to receive power from a power source. Accordingly, in many applications, some type of voltage conversion device is required in order to provide a generally lower operating voltage to one or more LED-based lighting units from more commonly available higher power supply voltages. The need of a voltage conversion device reduces the efficiency, costs more and also makes it difficult to miniaturize an LED-based lighting device.

U.S. Pat. No. 7,781,979 provides an apparatus for controlling series-connected LEDs. Two or more LEDs are connected in series. A series current flows through the LEDs when an operating voltage is applied. One or more controllable current paths are connected in parallel with at least an LED for partially diverting the series current around the LED. The apparatus permits the use of operating voltages such as 120V AC or 240V AC without requiring a voltage conversion device.

As more and more LED-based lighting units are used in high brightness lighting equipment, there is a strong need to design methods and apparatus that can drive and connect the LED-based lighting units intelligently and efficiently to increase the utilization of the LEDs and provide stable and high brightness by using the readily available AC source from a wall power unit. In addition, it is also highly desirable to provide many different lighting modes for the connected LED-based lighting units so that the brightness can be controlled properly according to different lighting requirements or the variation of the voltage level of the AC source.

SUMMARY OF THE INVENTION

The present invention has been made to meet the above mentioned needs in the application of LED-based lighting units. A primary object of the present invention is to provide an apparatus that can flexibly connect a plurality of LED-based lighting units in such a way that each of the LED-based lighting units may be connected in series or in parallel with its neighboring LED-based lighting unit, or by-passed.

Accordingly, the apparatus of the present invention comprises a plurality of LED-based lighting units interleaved with a plurality of switching units controlled by a controller. Each switching unit is connected with a leading LED-based lighting unit and a trailing LED-based lighting unit. The switching unit can be configured to connect the two LED-based lighting units in parallel or in series, or to bypass the leading LED-based lighting unit. An input voltage supply is connected to the first LED-based lighting unit to supply power to the apparatus and a current control device connects the last LED-based lighting unit to ground.

In a preferred embodiment of the present invention, each switching unit comprises a first parallel connection switch for connecting two respective positive terminals of the leading and trailing LED-based lighting units, and a second parallel connection switch for connecting two respective negative terminals of the leading and trailing LED-based lighting units. In addition, each switching unit further comprises a series connection switch for connecting the negative terminal of the leading lighting unit to the positive terminal of the trailing lighting unit.

Another object of the present invention is to provide an apparatus for controlling the connection of the plurality of LED-based lighting units according to the voltage level of the input voltage supply or the voltage level across the current control device, or the voltage levels of both of them. In the preferred embodiments of the present invention, the current control device may be a current sensing resistor or a variable current source.

According to one preferred embodiment of the invention, all the plurality of LED-based lighting units are connected in series when the input voltage supply is at a maximum voltage level, and all the plurality of LED-based lighting units are connected in parallel when the input voltage supply is at a minimum voltage level. As the voltage level of the input voltage supply decreases, the number of LED-based lighting units connected in parallel increases, and vice versa.

It is also an object of the present invention to provide various methods for driving the LED-based lighting units in order to provide multiple lighting modes by connecting some of the LED-based lighting units in series and some of the LED-based lighting units in parallel or by-passing some of the LED-based lighting units. Five examples of driving methods each providing multiple lighting modes in a different way are provided for the controller to control the plurality of switching units.

BRIEF DESCRIPTION OF THE DRAWINGS

The present invention will be apparent to those skilled in the art by reading the following detailed description of preferred embodiments thereof, with reference to the attached drawings, in which.

DETAILED DESCRIPTION OF THE PREFERRED EMBODIMENT

Figure 1:
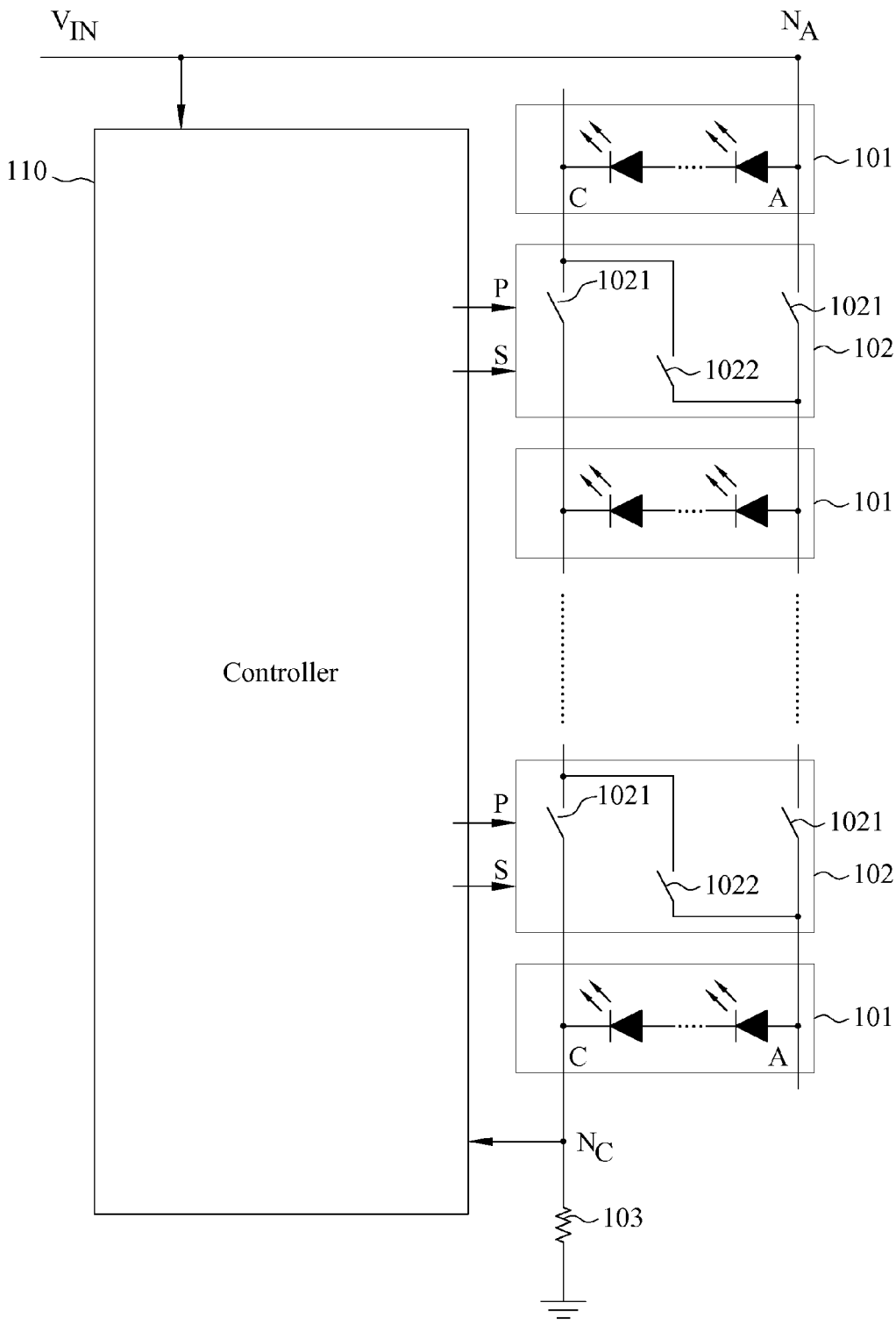
FIG. 1 is a circuit block diagram of an apparatus for controlling LED-based lighting units according to a preferred embodiment of the present invention.

The accompanying drawings are included to provide a further understanding of the invention, and are incorporated in and constitute a part of this specification. The drawing illustrates embodiments of the invention and, together with the description, serves to explain the principles of the invention.

FIG. 1 shows a circuit block diagram of an apparatus for controlling LED-based lighting units according to a preferred embodiment of the present invention. The apparatus comprises a plurality of LED-based lighting units 101 connected between nodes $N_A$ and $N_C$. Input voltage $V_{IN}$ provides power to the plurality of LED-based lighting units 101 through node $N_A$ and a current sensing resistor 103 connects node $N_C$ to ground. Each lighting unit 101 includes at least one or more LEDs connected in series, parallel or their combination, between positive terminal A and negative terminal C of the lighting unit.

As can be seen from FIG. 1, the apparatus further comprises a plurality of switching units 102 interleaved with the plurality of LED-based lighting units. Each switching unit 102 is disposed between two adjacent lighting units 101 to connect the two adjacent lighting units through their respective positive and negative terminals A and C. Each switching unit 102 comprises two parallel-connection switches 1021 for connecting the positive and negative terminals A and C of the leading LED-based lighting unit 101 respectively to the positive and negative terminals A and C of the trailing LED-based lighting unit 101. Each switching unit 102 also comprises a series-connection switch 1022 for connecting the negative terminal C of the leading LED-based lighting unit 101 to the positive terminal A of the trailing LED-based lighting unit 101.

According to the present invention, the switching unit 102 has three different modes of operation. In the first mode of operation, the two parallel-connection switches 1021 are turned off and the series-connection switch 1022 is turned on. As a result, the negative terminal C of the leading LED-based lighting unit 101 is connected to the positive terminal A of the trailing LED-based lighting unit 101. In other words, two adjacent LED-based lighting units are connected in series when the switching unit 102 between them is controlled to operate in the first mode.

In the second mode of operation, the two parallel-connection switches 1021 are turned on and the series-connection switch 1022 is turned off. As can be seen from FIG. 1, the positive terminal A and negative terminal C of the leading LED-based unit 101 are directly connected to the positive terminal A and negative terminal C of the trailing LED-based lighting unit 101. Therefore, two adjacent LED-based lighting units 101 are connected in parallel through the connections of positive and negative terminals A and C when the switching unit 102 between them is controlled to operate in the second mode.

In the third mode of operation, the parallel-connection switch 1021 in the switching unit 102 that connects the two positive terminals A of the leading and trailing LED-based lighting units is turned on, and the serial-connection switch 1022 is also turned on to connect the negative terminal C of the leading LED-based lighting unit to the positive terminal A of the trailing LED-based lighting unit. The parallel-connection switch 1021 that connects the two negative terminals C of the leading and trailing LED-based lighting units is turned off. As a result, the two terminals A and C of the leading LED-based lighting units 101 are all shorted to the positive terminal A of the trailing LED-based lighting unit, and therefore the leading LED-based lighting unit is by-passed in the third mode of operation.

According to the present invention, each switching unit 102 in the apparatus is controlled separately. As shown in FIG. 1, the apparatus further comprises a controller 110 that is used to send a respective set of control signals P and S to each switching unit 102. The two control signals P and S can control each switching unit 102 to operate in one of the three modes described above. Because each pair of two adjacent LED-based lighting units 101 can be connected in parallel or in series, or the leading LED-based lighting unit 101 can be by-passed by controlling the switching unit 102 between them, the plurality of lighting units in the apparatus can be controlled in many different lighting modes using the controller 110.

In this preferred embodiment, the last lighting unit is connected to one end of the current sensing resistor 103 at node $N_C$. The other end of the current sensing resistor 103 is connected to ground. Node $N_C$ is also connected to the controller 110 so that the voltage level at node $N_C$ can be detected by the controller 110. The plurality of switching units 102 can be controlled by the controller 110 according to the voltage level across the current sensing resistor 103 at node $N_C$, the voltage level of input voltage $V_{IN}$ supplied to node NA, or the combination of the two voltage levels.

Figure 2:
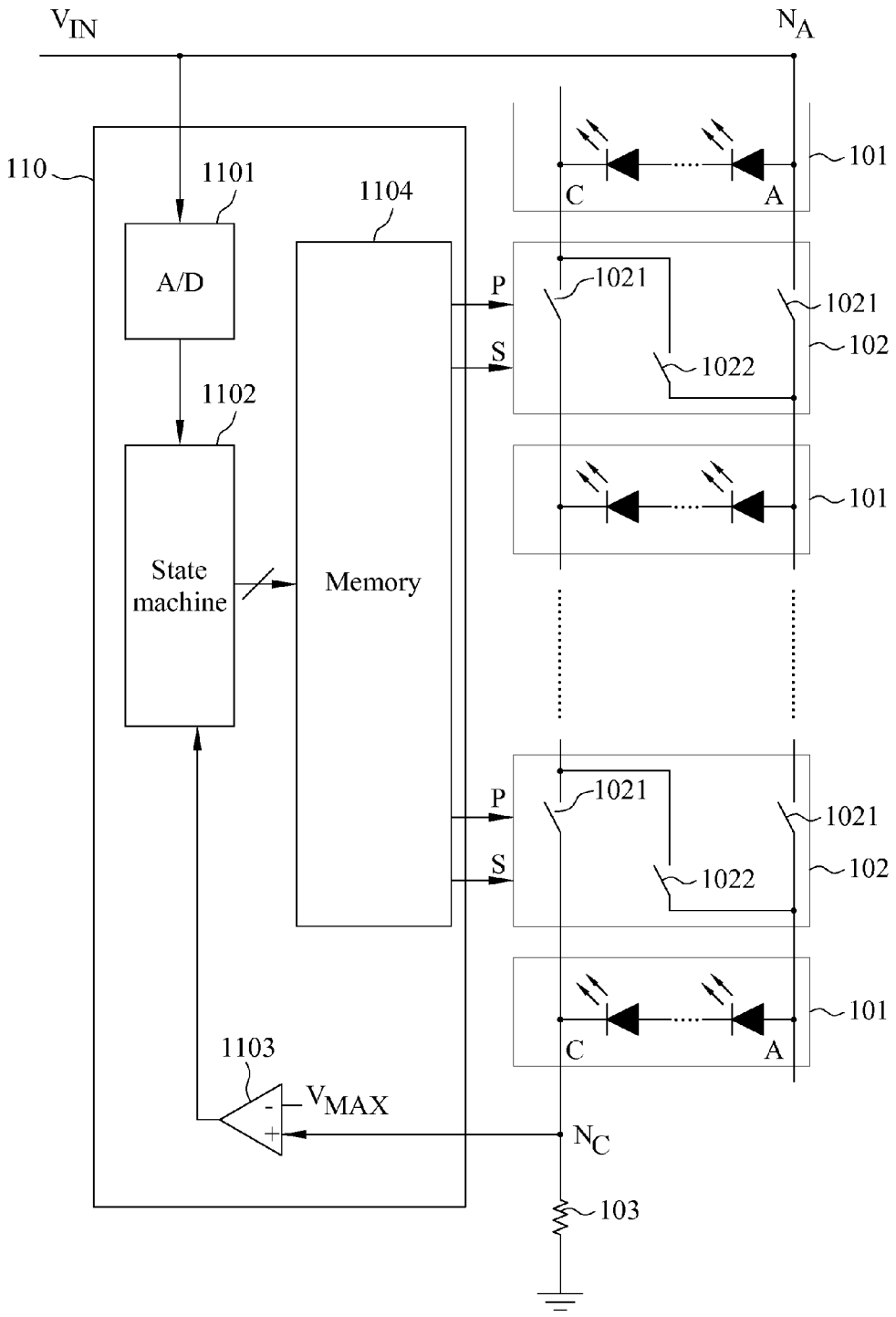
FIG. 2 shows an exemplar block diagram of the controller in the apparatus shown in FIG. 1.

FIG. 2 shows an exemplar block diagram of the controller 110 according to the embodiment shown in FIG. 1. An A/D converter 1101 in the controller 110 converts input voltage $V_{IN}$ into a digital signal which is sent to a state machine 1102. The voltage level at node $N_C$ is detected by a sensing amplifier 1103 which also outputs a signal to the state machine 1102. The logic of controlling the plurality of switching units 102 is implemented in the state machine 1102 along with a memory device 1104 to send control signals P and S to each switching unit 102.

According to the present invention, the LED in the LED-based lighting unit 101 refers to all types of light emitting diodes such as semi-conductor and organic light emitting diodes that may emit light at various frequency spectrums. The apparatus may comprise any number of LED-based lighting units and each LED-based lighting unit may comprise any number of LED devices according to the requirements in the specific application of the apparatus. The switching unit 102 refers generally to a switching unit that has switching devices with appropriate controlling mechanism for opening or closing the connection or one or more circuits. The switching devices may be mechanical or electrical, or semiconductor switches implemented with integrated circuits.

Figure 3:
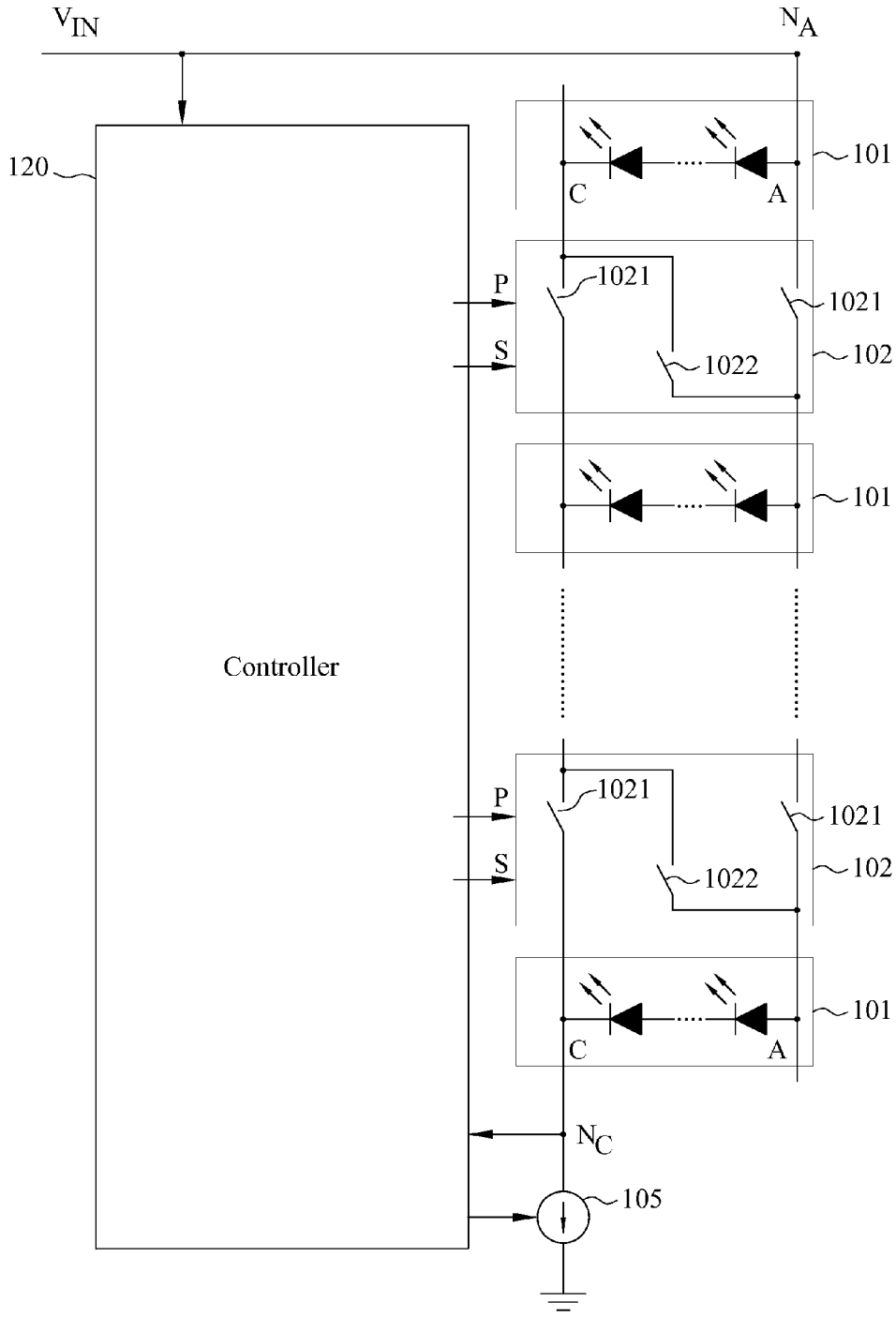
FIG. 3 is a circuit block diagram of an apparatus for controlling LED-based lighting units according to another preferred embodiment of the present invention.

FIG. 3 shows a circuit block diagram of an apparatus for controlling LED-based lighting units according to another preferred embodiment of the present invention. In this embodiment, the apparatus also comprises a plurality of LED-based lighting units 101 interleaved with a plurality of switching units 102 and connected between node $N_A$ and node $N_C$. The current sensing resistor 102 illustrated in the embodiment of FIG. 1 is replaced by a variable current source 105. A controller 120 controls the current flowing through the variable current source 105 in addition to controlling the plurality of switching units 102.

In this embodiment, the voltage level of the variable current source 105 at node $N_C$ is also detectable. The plurality of switching units 102 can be controlled by the controller 120 according to the voltage level across the variable current source 105 at node $N_C$, the voltage level of the input voltage $V_{IN}$ supplied to node $N_A$, or the combination of the two voltage levels.

Figure 4:
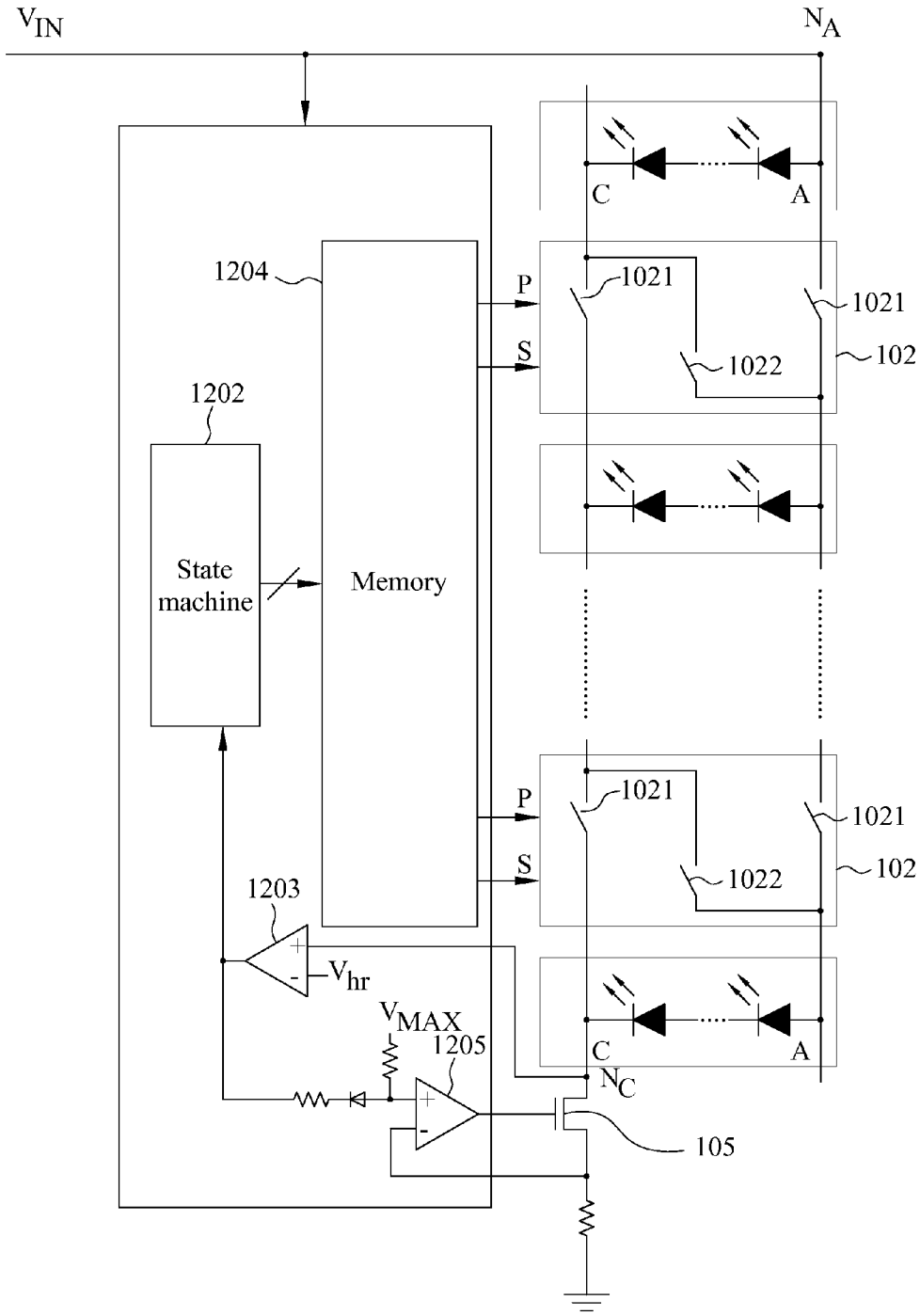
FIG. 4 shows an exemplar block diagram of the controller in the apparatus shown in FIG. 3.

FIG. 4 shows an exemplar block diagram of the controller 120 according to the embodiment of FIG. 3. The logic of controlling the plurality of switching units 102 is implemented in a state machine 1202 along with a memory device 1204 to send separate control signals P and S to each switching unit 102. The voltage level at node $N_C$ is detected by a sensing amplifier 1203 which outputs a signal to the state machine 1202. A current control circuit 1205 controls the variable current source 105.

In accordance with the apparatus for controlling LED-based lighting units of the present invention, two adjacent LED-based lighting units 101 can be controlled to be connected in parallel or series, or with the leading LED-based lighting unit by-passed. As a result, the plurality of LED-based lighting units 101 can be controlled with different driving methods to provide many different lighting modes based on how each individual LED-based lighting unit 101 is configured to connect its neighboring LED-based lighting unit. For example, the apparatus can switch from one lighting mode to another lighting mode based on the variation in input voltage $V_{IN}$.

Figure 5:
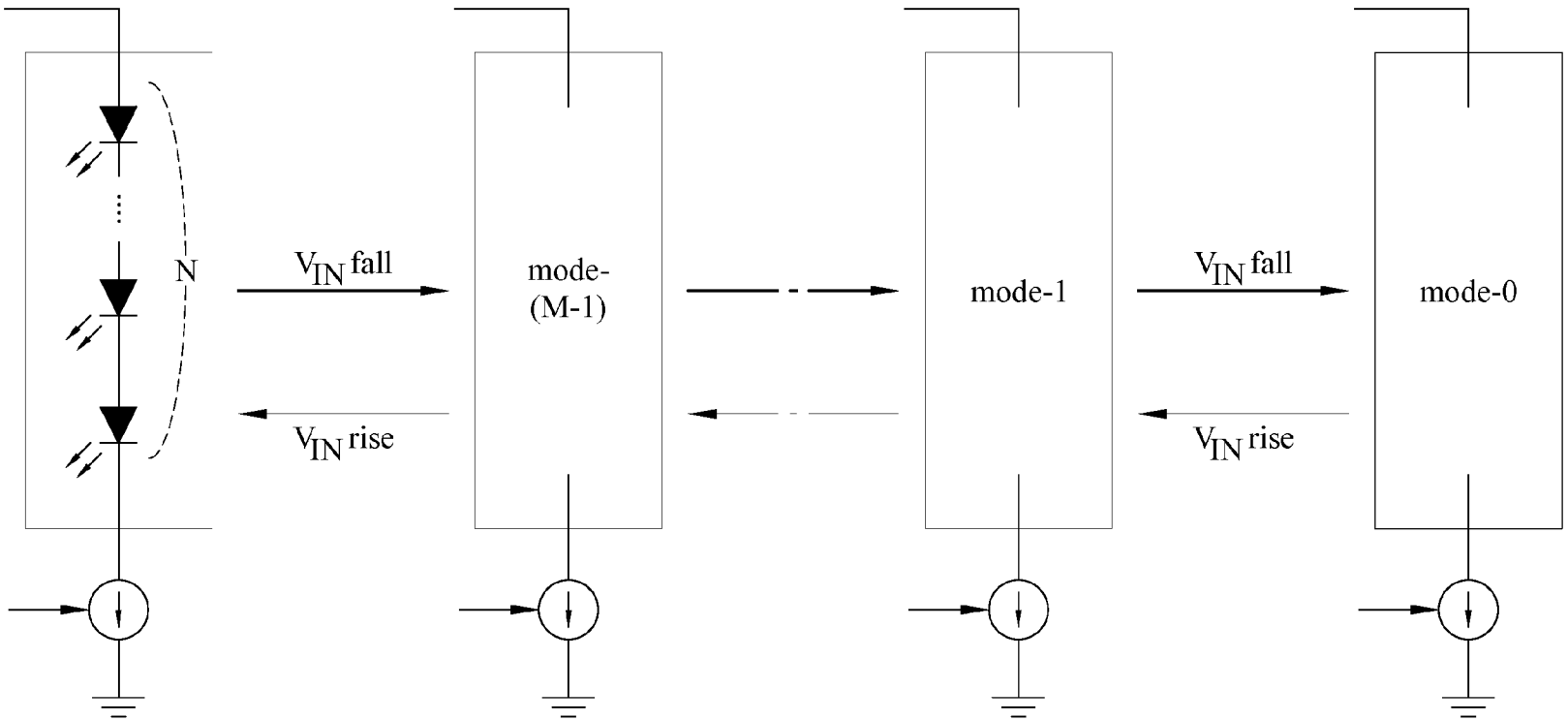
FIG. 5 shows an example of driving and connecting the plurality of LED-based lighting units of the apparatus to provide multiple lighting modes based on voltage level variation of the input voltage supply according to the present invention.

FIG. 5 shows an example of multiple lighting modes provided by the apparatus according to the present invention. The apparatus can be controlled to operate in mode-0, mode-1, . . . , and mode-M based on the variation of input voltage $V_{IN}$. When input voltage $V_{IN}$ is at a highest level, the apparatus operates in mode-M in which every two adjacent LED-based lighting units 101 are controlled to connect in series by the switching unit 102 between them so that all the LEDs in the LED-based lighting units 101 are connected in series. As the voltage level of input voltage $V_{IN}$ decreases from the highest level, some of the LED-based lighting units are controlled to connect in parallel and the lighting mode of the apparatus switches from mode-M to mode-(M-1), mode-(M-2), . . . , and so on.

To the contrary, when input voltage $V_{IN}$ is at a lowest level, the apparatus operates in mode-0 in which every two adjacent LED-based lighting units 101 are controlled to connect in parallel by the switching unit 102 between them so that all the LED-based lighting units are connected in parallel. As the voltage level of input voltage $V_{IN}$ increases from the lowest level, more and more LED-based lighting units are controlled to connect in series and the lighting mode of the apparatus switches from mode-0 to mode-1, mode-2, . . . , and so on.

Figure 6:
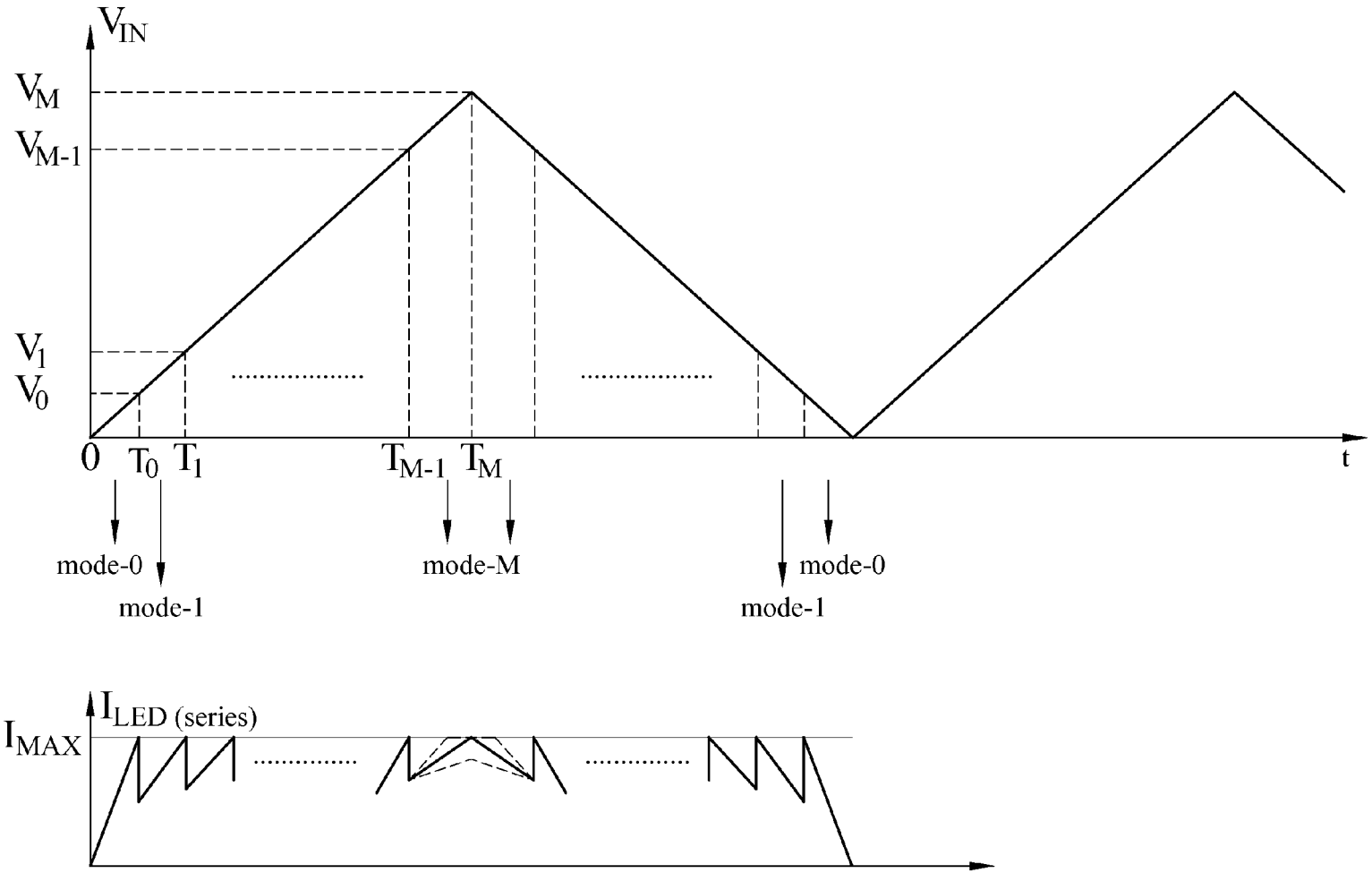
FIG. 6 illustrates the voltage level of input voltage $V_{IN}$ and the corresponding series current $I_{LED}$ that flows through the apparatus in different lighting modes of FIG. 5.

FIG. 6 illustrates the voltage level of input voltage $V_{IN}$ and the corresponding series current $I_{LED}$ that flows through the apparatus under different modes. In general, an AC voltage is rectified before providing power to an LED-based lighting device. Therefore, the voltage level of input voltage $V_{IN}$ varies according to the positive cycles of rectified sinusoidal waves. For simplicity, FIG. 6 uses a triangular wave to illustrate the variation of input voltage $V_{IN}$ and the operation of different lighting modes of this invention. As an example with the voltage level of a triangular wave, $V_{IN}$ can be expressed as $(V_M/T_M)t$, where $V_M$=120 volts and $T_M$=(1/240) seconds for 120 volts AC voltage of 60 Hz.

As shown in FIG. 6, when the voltage level of input voltage $V_{IN}$ increases from 0 to $V_0$, the apparatus operates in mode-0. In other words, during time 0 to $T_0$, the lighting mode is mode-0. When the voltage level of input voltage $V_{IN}$ increases from $V_0$ to $V_1$ during time $T_0$ to $T_1$, the apparatus operates in lighting mode-1. Similarly, when the voltage level of input voltage $V_{IN}$ increases from $V_{M-1}$ to $V_M$ during time $T_{M-1}$ to $T_M$, the apparatus operates in lighting mode-M. As can be seen in FIG. 6, at $T_0$, $T_1$, . . . , $T_M$, the series current $I_{LED}$ flowing through the LED-based lighting units has the maximum level $I_{MAX}$, and the current drops and then gradually increases to the maximum level between each period $T_{i-1}$ to $T_i$. When the voltage level of input voltage $V_{IN}$ decreases from the maximum level $V_M$, the apparatus operates similarly but in a reverse way.

Figure 7:
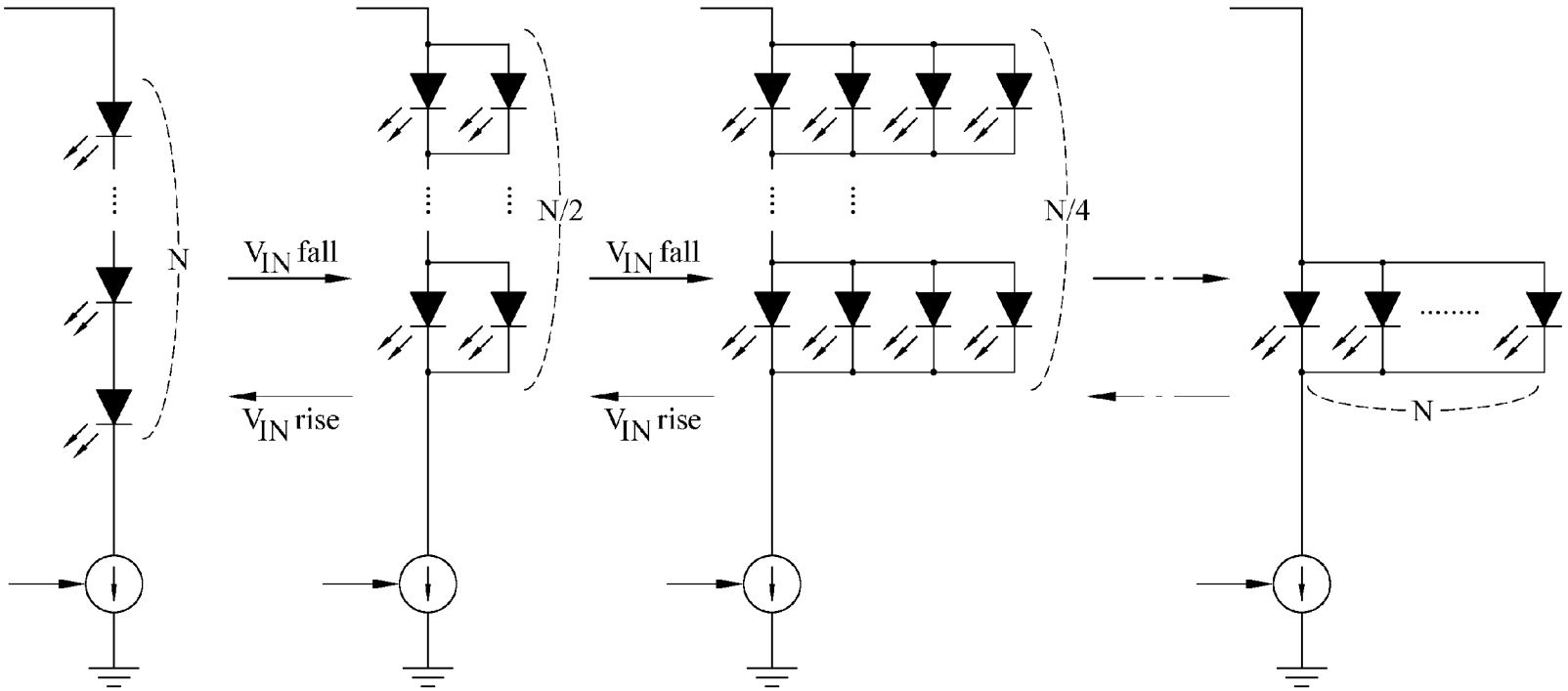
FIG. 7 illustrates a first driving method in which the plurality of LED-based lighting units is controlled to connect in a full series connection to more and more parallel connections according to the present invention as input voltage $V_{IN}$ decreases and vice versa.

To further explain the operation and lighting modes of the apparatus according to the present invention, a few examples of implementing different driving methods for multiple lighting modes to control the connections of the LED-based lighting units will be described. For simplicity, it is assumed that the total number of LED-based lighting units in the apparatus is N and each LED-based lighting unit has only one LED. In each driving method, the present invention provides M different lighting modes for the apparatus, where M depends on N but may be different for a different driving method. FIG. 7 illustrates a first driving method in which the plurality of lighting units in the apparatus is switched from a full series connection to more and more parallel connections as input voltage $V_{IN}$ decreases and vice versa.

As can be seen from FIG. 7, there is a total of N lighting units in the apparatus with $N=2^M$ and each lighting unit is shown to comprise only one LED for simplicity. In the lighting mode shown on the most left where input voltage $V_{IN}$ has a highest level, all lighting units are connected in series. As the input voltage decreases, the apparatus switches into the next lighting mode shown on the second left and every two LED-based lighting units are controlled to connect in parallel. Therefore, there are N/2 groups of LED-based lighting units connected in series in the apparatus with each group having two LED-based lighting units connected in parallel.

As the input voltage decreases further, the apparatus switches into the following lighting mode with every four LED-based lighting units being controlled to connect in parallel to form N/4 groups of LED-based lighting units connected in series with each group having 4 LED-based lighting units connected in parallel. As the input voltage further decreases, the number of groups of LED-based lighting units decreases with each group having more LED-based lighting units connected in parallel. When input voltage $V_{IN}$ decreases to a lowest level, the lighting mode is shown on the most right and has all the LED-based lighting units connected in parallel. When the input voltage starts to increase, the apparatus switches lighting modes in the reverse way. Because there are $N=2^M$ LED-based lighting units in the apparatus, this driving method provides M+1 different lighting modes for the apparatus of the present invention.

Figure 8A:
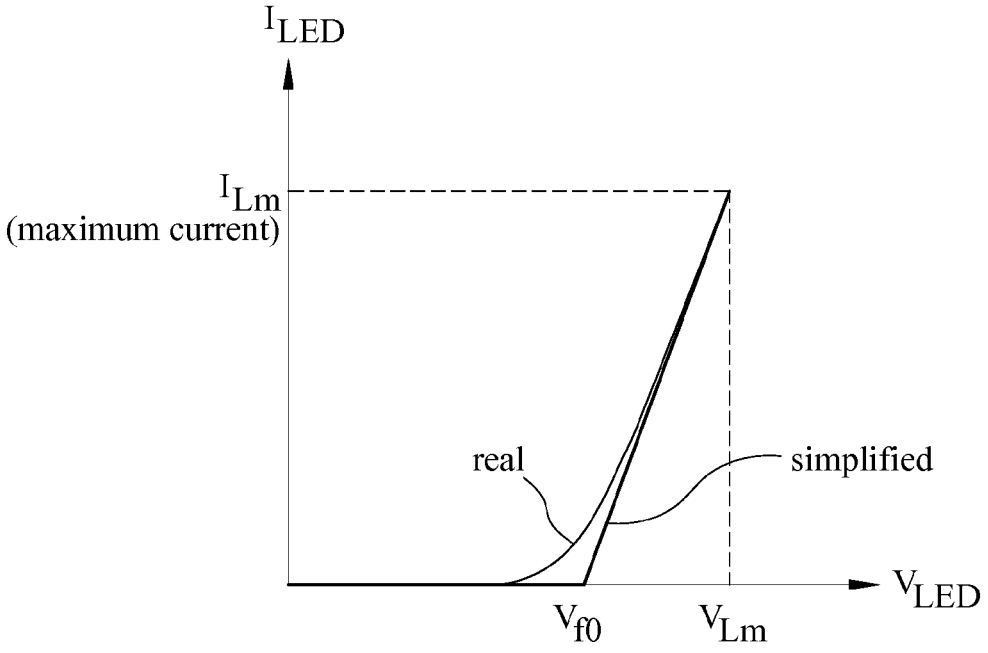
FIG. 8A shows an I-V characteristic curve for a typical LED.
Figure 8B:
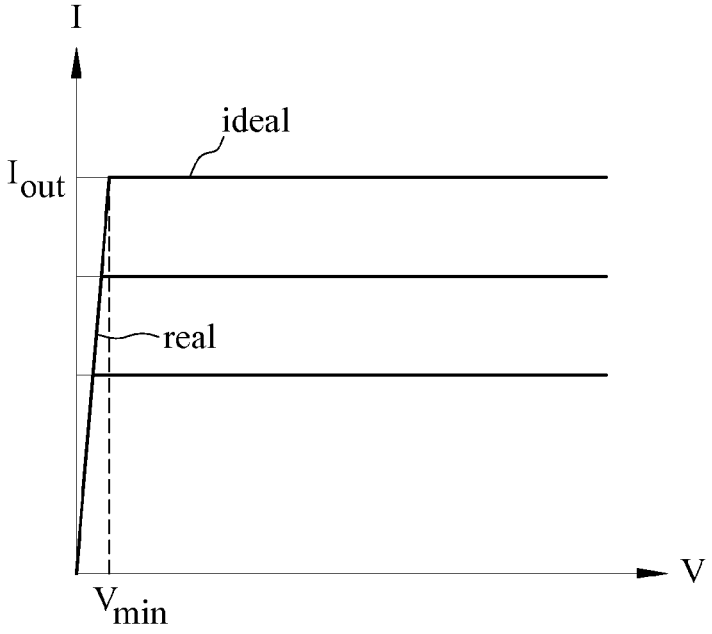
FIG. 8B shows an ideal current source with no limitation in the minimum voltage $V_{min}$.

The brightness provided by the LED-based lighting units of the apparatus according to the first driving method of the present invention can be analyzed based on the I-V characteristic of the LED. FIG. 8A shows an I-V characteristic curve for a typical LED. For simplicity, the I-V characteristic curve is modeled as piecewise linear. When the input voltage $V_{LED}$ applied to an LED is greater than a forward voltage $V_{f0}$, the current $I_{LED}$ flowing through the LED is linearly proportional to the input voltage $V_{LED}$. When the input voltage $V_{LED}$ reaches $V_{Lm}$, the current $I_{LED}$ has a maximum value $I_{Lm}$. FIG. 8B shows an ideal current source with no limitation in the minimum voltage $V_{min}$.

The piecewise linear I-V characteristic curve can be expressed as follows:

$$I_{LED} = 0 \text{ when } V_{LED} \le V_{f0}, \text{ and}$$

$$I_{LED} = \frac{I_{LM}}{V_{Lm} - V_{f0}}(V_{LED} - V_{f0}) \text{ when } V_{LED} \ge V_{f0},$$

where $I_{Lm}$ is the maximum current provided to the LED by the current source. The following analysis assumes that there is no power loss and each LED-based lighting unit has one LED with the same I-V characteristics with a forward voltage $V_{f0}$. The total number of LED-based lighting units is:

$$N < \left\lfloor \frac{V_M}{V_{f0}} \right\rfloor,$$

where $$\left\lfloor \frac{V_M}{V_{f0}} \right\rfloor$$

stands for the integer part of the number $(V_M/V_{f0})$, $V_M$ is the maximum voltage level provided to the apparatus through input voltage $V_{IN}$.

The total brightness of a plurality of LED-based lighting units is proportional to the sum of the average current flowing through each LED, i.e., $$\sum_{j=1}^{N}\left(\frac{\sum_{k=0}^{M}\int_{T_{k-1}}^{T_k} I_{LED(j,k)}\,dt}{T_M}\right) = \frac{\sum_{k=0}^{M}\sum_{j=1}^{N}\int_{T_{k-1}}^{T_k} I_{LED(j,k)}\,dt}{T_M},$$

where $I_{LED/(j,k)}$ represents the current flowing through the $j^{th}$ LED in lighting mode-k illustrated in FIG. 6 assuming each LED-based lighting unit only has one LED.

For the first driving method illustrated in FIG. 7, there are M+1 different modes for the total of N LED-based lighting units with $M=\log_2 N$ and for lighting mode-k, the current flowing through the LEDs is:

$$I_{LED(1,k)}=I_{LED(2,k)}=\ldots=I_{LED(N,k)},$$

where k=0, 1, 2, . . . , M. For lighting mode-0, the total current flowing through each LED is:

$$\int_0^{T_0} I_{LED(j,0)}dt=\int_{T_{Z(0)}}^{T_0} I_{LED(j,0)}dt, \text{ where } I_{LED(j,0)}=0 \text{ when } t<T_{Z(0)}.$$

With $$T_0 = \frac{V_{Lm}}{V_M}\times T_M \text{ and } T_{Z(0)} = \frac{V_{f0}}{V_M}\times T_M,$$

it can be further shown that:

$$\int_0^{T_0} I_{LED(j,0)}\,dt = \int_{T_{Z(0)}}^{T_0}\left(\frac{I_{Lm}}{V_{Lm}-V_{f0}}\right)\times\left(\frac{V_M}{T_M}t - V_{f0}\right)dt = \frac{T_M}{2\cdot V_M}\times I_{Lm}\times(V_{Lm}-V_{f0}).$$

Similarly, for lighting mode-k, the total current flowing through each LED is:

$$\int_{T_{k-1}}^{T_k} I_{LED(j,k)}dt=\int_{T_{Z(k)}}^{T_k} I_{LED(j,k)}dt, \text{ where } I_{LED(j,k)}=0 \text{ when } t<T_{Z(k)}.$$

With $$T_k = \frac{V_{Lm}\times 2^k}{V_M}\times T_M,\ T_{Z(k)} = \frac{V_{f0}\times 2^k}{V_M}\times T_M,$$

it can be further shown that:

$$\int_{T_{k-1}}^{T_k} I_{LED(j,k)}\,dt = \int_{T_{Z(k)}}^{T_k}\left(\frac{I_{Lm}}{V_{Lm}-V_{f0}}\right)\times\left(\frac{V_M}{T_M\times 2^k}t - V_{f0}\right)dt = \frac{T_M\times 2^{k-1}}{V_M}\times I_{Lm}\times(V_{Lm}-V_{f0}).$$

Figure 9:
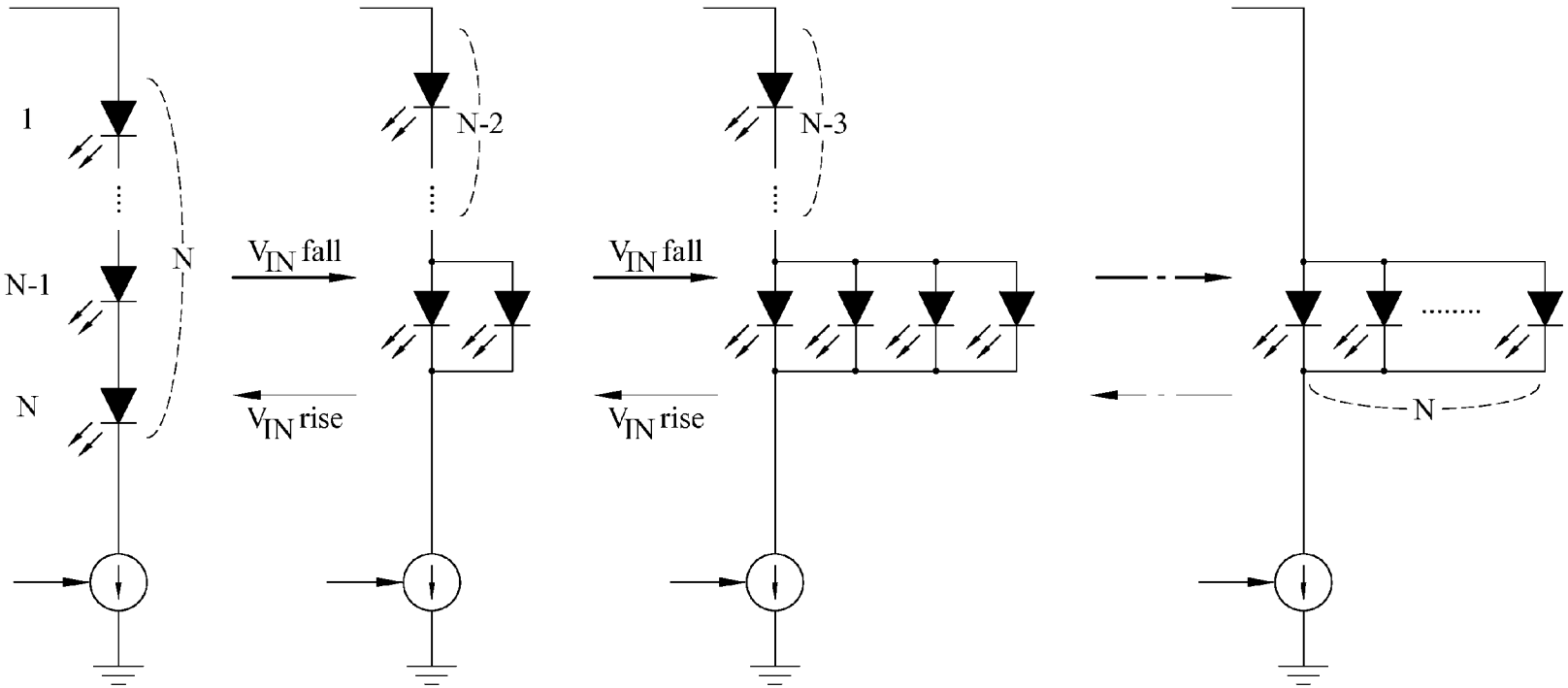
FIG. 9 illustrates a second driving method for controlling the plurality of LED-based lighting units to provide multiple lighting modes according to the present invention.

FIG. 9 illustrates a second driving method in which the plurality of LED-based lighting units in the apparatus is also switched from a full series connection to more and more parallel connections as input voltage $V_{IN}$ decreases and vice versa. In this implementation, the lighting mode when input voltage $V_{IN}$ is at a highest level is shown on the most left with all the LED-based lighting units connected in series. As the input voltage decreases, there is only one group of LED-based lighting units connected in parallel and the group is connected with the remaining LED-based lighting units in series. However, the number of LED-based lighting units in the group increases as the apparatus switches into the next lighting mode when the input voltage decreases, and the number of the remaining LED-based lighting units connected in series decreases.

With reference to FIG. 9, the lighting mode shown on the second left has two LED-based lighting units connected in parallel, and the lighting mode on the third left has three LED-based lighting units connected in parallel, and the lighting mode on the most right has all the LED-based lighting units connected in parallel as the input voltage continues to decrease to a lowest level. Similar to the implementation illustrated in FIG. 7, when the input voltage increases, the apparatus switches lighting modes in the reverse way. As can be seen from FIG. 9, the number of different lighting modes provided in this driving method is N if the total number of LED-based lighting units is N.

For the second driving method illustrated in FIG. 9, there are N different lighting modes for the total of N lighting units and for mode-k, there are k LEDs connected in series with the group of (N-k) LEDs that are connected in parallel. The current flowing through the LEDs is:

$$I_{LED(1,k)}=I_{LED(2,k)}=\ldots=I_{LED(2,k)}=\ldots=I_{LED(k,k)}=I_{Lm}, \text{ and}$$

$$I_{LED(k+1,k)}=I_{LED(k+2,k)}=\ldots=I_{LED(N,k)}=I_{Lm}/(N-k),$$

where k=0, 1, . . . , N−1. For lighting mode-0, the total current flowing through each LED in this driving method is identical to the first driving method discussed before, i.e., $$\int_0^{T_0} I_{LED(j,0)}\,dt = \int_{T_{Z(0)}}^{T_0}\left(\frac{I_{Lm}}{V_{Lm}-V_{f0}}\right)\times\left(\frac{V_M}{T_M}t-V_{f0}\right)dt=\frac{T_M}{2\cdot V_M}\times I_{Lm}\times(V_{Lm}-V_{f0}).$$

For lighting mode-k, assuming $$V_0=V_{Lm} \text{ and } V_k=k\times V_{Lm}+\left(V_{f0}+\frac{V_{Lm}-V_{f0}}{N-k}\right) \text{ for } k\geq 1.$$

With $$T_k=\frac{V_k}{V_M}\times T_M,$$

$$V_{LED(total)}=V_{k-1}+\left(\frac{t-T_{k-1}}{T_k-T_{k-1}}\right)\times(V_k-V_{k-1})=k\times V_{LED(1,k)}+V_{LED(N,k)},$$

the current flowing through the LED can be shown as:

$$\frac{I_{Lm}}{V_{Lm}-V_{f0}}(V_{LED(1,k)}-V_{f0})=I_{LED(1,k)}, \text{ and}$$

$$\frac{I_{Lm}}{V_{Lm}-V_{f0}}(V_{LED(N,k)}-V_{f0})=I_{LED(N,k)}=\frac{I_{LED(1,k)}}{N-k}.$$

Therefore,

-continued $$I_{LED(1,k)}=\frac{\left[V_{k-1}+\left(\frac{t-T_{k-1}}{T_k-T_{k-1}}\right)\times(V_k-V_{k-1})-(k+1)\times V_{f0}\right]}{\left(k+\frac{1}{N-k}\right)\times\left(\frac{V_{Lm}-V_{f0}}{I_{Lm}}\right)},$$

and the total current flowing through the LED is:

$$\int_{T_{k-1}}^{T_k} I_{LED(1,k)}\,dt=\int_{T_{Z(k)}}^{T_k} I_{LED(1,k)}dt \text{ if } V_{f0}\geq\frac{V_{k-1}}{k+1},$$

where $$T_{Z(k)}=T_{k-1}+\frac{(T_k-T_{k-1})\times((k+1)\times V_{f0}-V_{k-1})}{(V_k-V_{k-1})}.$$

Figure 10:
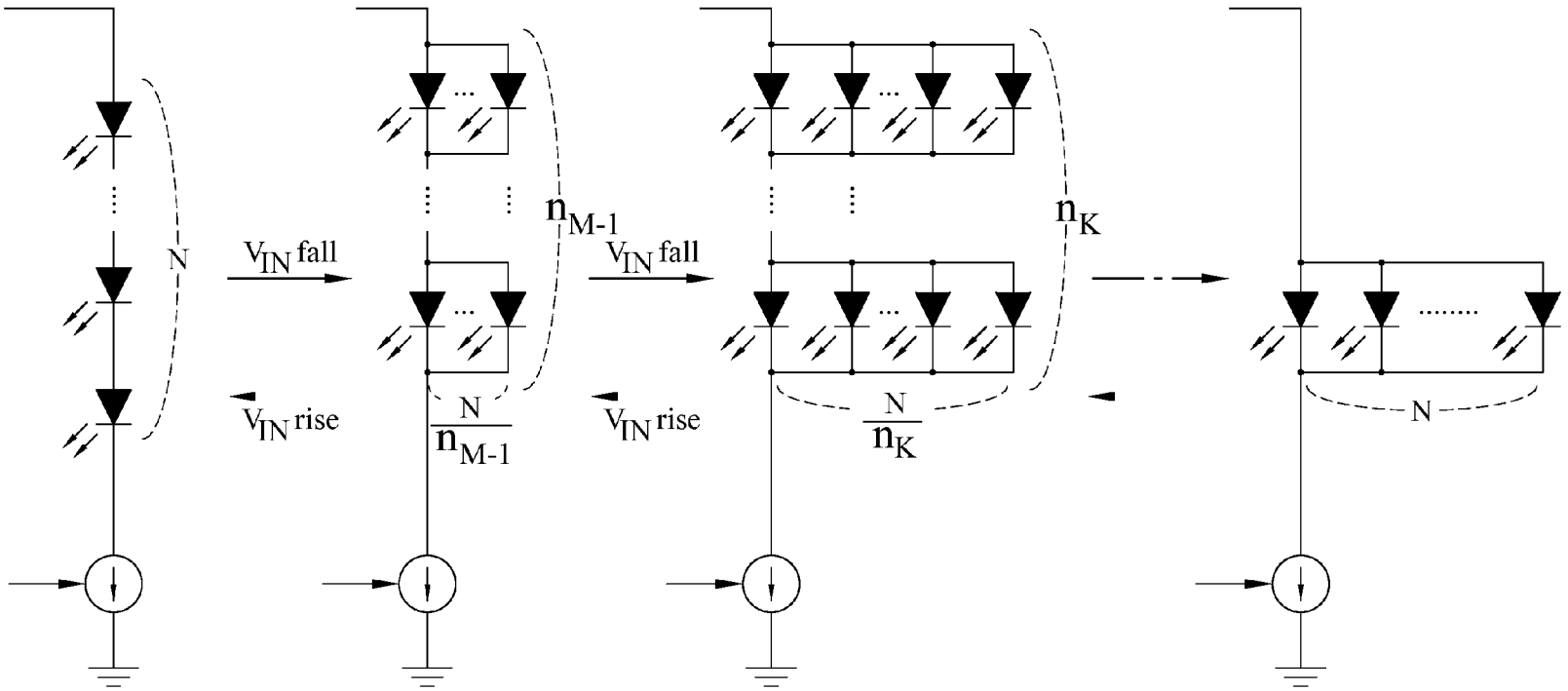
FIG. 10 illustrates a third driving method for controlling the plurality of LED-based lighting units to provide multiple lighting modes according to the present invention.

In addition to the first and second driving methods illustrated and discussed above, a third driving method as shown in FIG. 10 can be implemented in the apparatus of the present invention. Assuming the total number of LED-based lighting units is N and there exists (M+1) dividers $n_0, n_1, \ldots,$ and $n_M$ in increasing order for N with $N/n_k$ is an integer number for k=0, 1, 2, . . . , and M. The third driving method according to this invention provides (M+1) lighting modes for the apparatus with lighting mode-k having $n_k$ groups of LED-based lighting units connected in series and each group having $N/n_k$ lighting units connected in parallel as illustrated in FIG. 10.

For lighting mode-k, the current flowing through the LEDs is:

$$I_{LED(1,k)}=I_{LED(2,k)}=\ldots=I_{LED(N,k)}.$$

With $$I_{LED(1,k)}=\left(\frac{I_{Lm}}{V_{Lm}-V_{f0}}\right)\times\left(\frac{V_M}{T_M\times n_k}\times t-V_{f0}\right), \text{ and}$$

$$T_k=\frac{V_{Lm}\times n_k}{V_M}\times T_M,$$

the total current flowing through the LED is:

$$\int_{T_{k-1}}^{T_k} I_{LED(1,k)}\,dt=\int_{T_{Z(k)}}^{T_k} I_{LED(1,k)}dt \text{ if } V_{f0}\geq\frac{n_{k-1}}{n_k}\times V_{Lm},$$

where $$T_{Z(k)}=\frac{V_{f0}\times n_k}{V_M}\times T_M.$$

Figure 11:
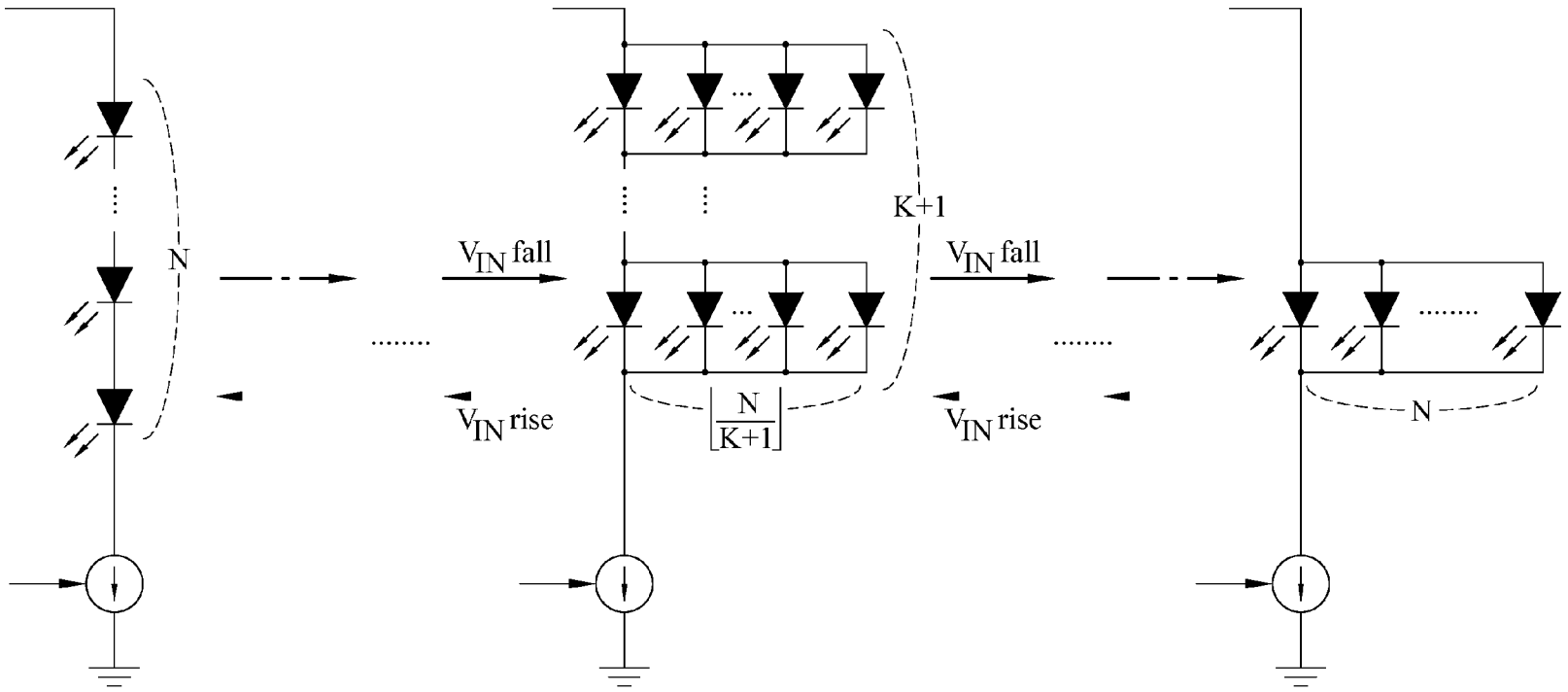
FIG. 11 illustrates a fourth driving method for controlling the plurality of LED-based lighting units to provide multiple lighting modes according to the present invention.

In accordance with the present invention, a fourth driving method can also be implemented for the apparatus to provide multiple lighting modes as shown in FIG. 11. In the fourth driving method, the LED-based lighting units are divided into (k+1) groups of LED-based lighting units for lighting mode-k. The (k+1) groups of lighting units are connected in series and the LED-based lighting units in each group are connected in parallel. In other words, each group has $$\left\lfloor\frac{N}{k+1}\right\rfloor$$

LED-based lighting units that are connected in parallel, where $$\left\lfloor\frac{N}{k+1}\right\rfloor$$

represents the integer part of the number N/(k+1).

If N/(k+1) is not an integer number, $$N_z = \left(N - (k+1) \times \left\lfloor \frac{N}{k+1} \right\rfloor\right)$$

lighting units are by-passed. The fourth driving method may provide N lighting modes. For lighting mode-k, k=0, 1, . . . , N−1, the current flowing through the LEDs is:

$$I_{LED(1,k)} = I_{LED(2,k)} = \ldots = I_{LED(N-Nz,k)}, \text{ and}$$

$$I_{LED(N-Nz+1,k)} = I_{LED(N-Nz+2,k)} = \ldots = I_{LED(N,k)} = 0.$$

With $$I_{LED(1,k)} = \left(\frac{I_{Lm}}{V_{Lm} - V_{f0}}\right) \times \left(\frac{V_M}{T_M \times (k+1)} \times t - V_{f0}\right), \text{ and}$$

$$T_k = \frac{V_{Lm} \times (k+1)}{V_M} \times T_M,$$

the total current flowing through the LED is:

$$\int_{T_{k-1}}^{T_k} I_{LED(1,k)}\, dt = \int_{T_{Z(k)}}^{T_k} I_{LED(1,k)}\, dt \text{ if } V_{f0} \geq \frac{k}{k+1} \times V_{Lm},$$

where $$T_{Z(k)} = \frac{V_{f0} \times (k+1)}{V_M} \times T_M.$$

Figure 12:
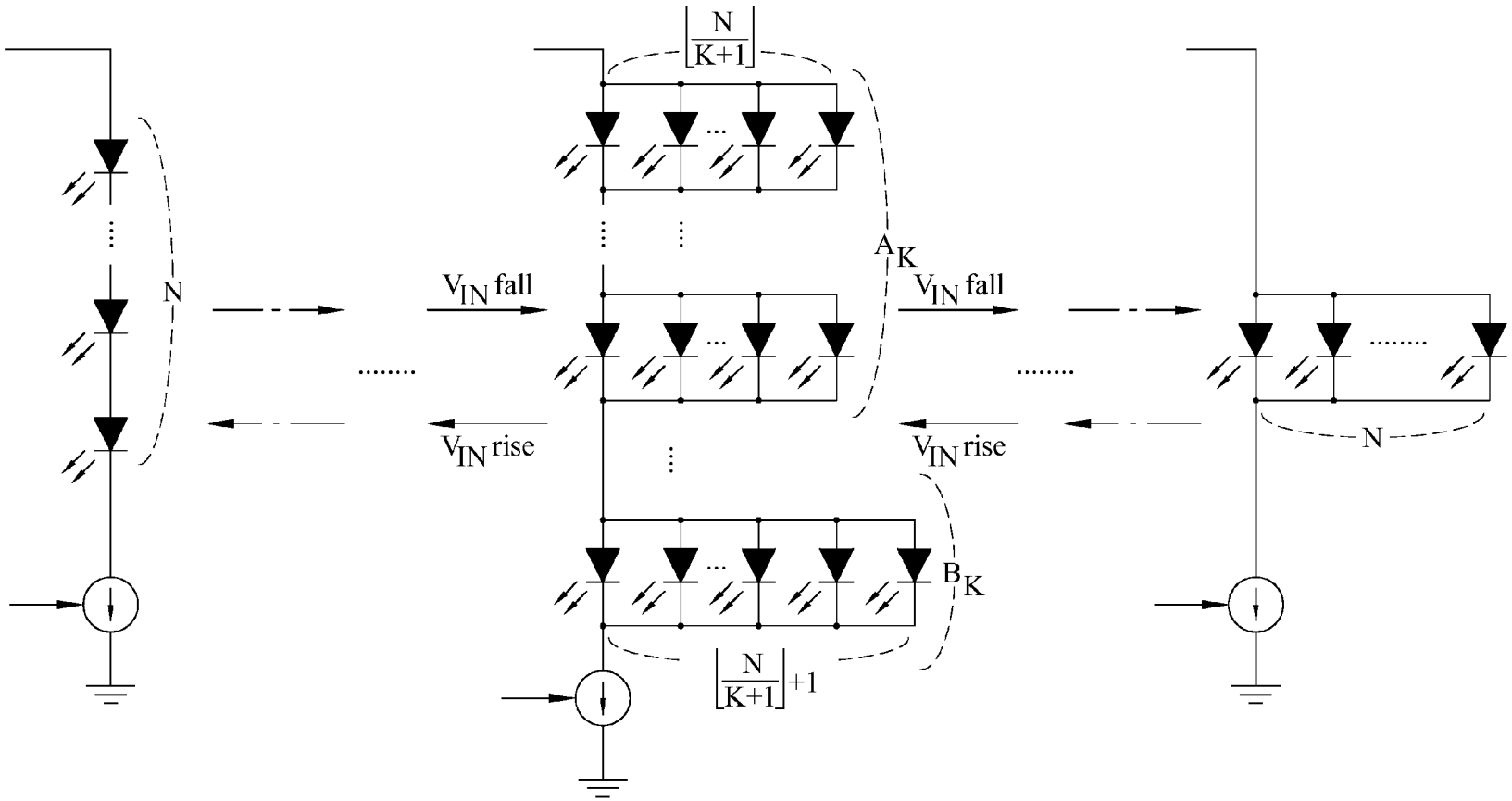
FIG. 12 illustrates a fifth driving method for controlling the plurality of LED-based lighting units to provide multiple lighting modes according to the present invention.

The present invention further provides a fifth driving method for the apparatus to provide multiple lighting modes as shown in FIG. 12. The fifth driving method is similar to the fourth driving method except that the $N_Z$ LED-based lighting units that are by-passed in the fourth driving method are uniformly distributed into some of the groups. In other words, in the (k+1) groups of LED-based lighting units, some groups have $$\left\lfloor \frac{N}{k+1} \right\rfloor$$

lighting units but other groups have $$\left(\left\lfloor \frac{N}{k+1} \right\rfloor + 1\right)$$

lighting units. For example, for lighting mode-k, there are $A_k$ groups each consisting of $$\left\lfloor \frac{N}{k+1} \right\rfloor$$

lighting units connected in parallel, and $B_k$ groups each consisting of $$\left(\left\lfloor \frac{N}{k+1} \right\rfloor + 1\right)$$

lighting units connected in parallel, where $A_k + B_k = (k+1)$. The (k+1) groups LED-based lighting units are connected in series.

For lighting mode-k, $$V_k = A_k \times V_{Lm} + B_k \times (V_{f0} + C_k \times (V_{Lm} - V_{f0})), \text{ where}$$

$$C_k = \frac{\left\lfloor \frac{N}{k+1} \right\rfloor}{\left\lfloor \frac{N}{k+1} \right\rfloor + 1}, \text{ and}$$

$$V_{LED(total)} = V_{k-1} + \left(\frac{t - T_{k-1}}{T_k - T_{k-1}}\right) \times (V_k - V_{k-1}) = A_k \times V_{LED(1,k)} + B_k \times V_{LED(N,k)}.$$

The current flowing through the LED can be shown as:

$$\frac{I_{Lm}}{V_{Lm} - V_{f0}} (V_{LED(1,k)} - V_{f0}) = I_{LED(1,k)},$$

$$\frac{I_{Lm}}{V_{Lm} - V_{f0}} (V_{LED(N,k)} - V_{f0}) = I_{LED(N,k)} = C_k \times I_{LED(1,k)}, \text{ and}$$

$$I_{LED(1,k)} = \frac{\left[V_{k-1} + \left(\frac{t - T_{k-1}}{T_k - T_{k-1}}\right) \times (V_k - V_{k-1}) - (k+1) \times V_{f0}\right]}{(A_k + B_k \times C_k) \times \left(\frac{V_{Lm} - V_{f0}}{I_{Lm}}\right)}.$$

Therefore, the total current flowing through the LED is $$\int_{T_{k-1}}^{T_k} I_{LED(1,k)}\, dt = \int_{T_{Z(k)}}^{T_k} I_{LED(1,k)}\, dt \text{ if } V_{f0} \geq \frac{V_{k-1}}{k+1},$$

$$\text{where } T_{Z(k)} = T_{k-1} + \frac{(T_k - T_{k-1}) \times ((k+1) \times V_{f0} - V_{k-1})}{(V_k - V_{k-1})}.$$

For the purpose of comparing the brightness of the LED-based lighting units achieved by the driving methods provided in the present invention with that of the known driving method in the prior art, the brightness of the LED-based lighting units using the approach disclosed in U.S. Pat. No. 7,781,979, which is assigned to Philips Solid-State Lighting Solutions, Inc., is also analyzed. The driving method is referred as Philips and it has N lighting modes, and for lighting mode-k, the current flowing through each LED is:

$$I_{LED(1,k)} = I_{LED(2,k)} = \ldots = I_{LED(k+1,k)} = I_{Lm}, \text{ and}$$

$$I_{LED(k+2,k)} = I_{LED(k+3,k)} = \ldots = I_{LED(N,k)} = 0.$$

Therefore, for lighting mode-0 and mode-1, the total current flowing through the LED is:

$$\int_0^{T_0} I_{LED(1,0)}\, dt = \frac{T_M}{2 \times V_M} \times I_{Lm} \times (V_{Lm} - V_{f0}), \text{ and}$$

$$\int_{T_0}^{T_1} I_{LED(1,1)}\, dt = \int_{T_0}^{T_1} I_{LED(2,1)}\, dt = \frac{T_M}{V_M} \times I_{Lm} \times (V_{Lm} - V_{f0}),$$

respectively. For lighting mode-k with k>=2, $$I_{LED(1,k)} = \left(\frac{I_{Lm}}{V_{Lm} - V_{f0}}\right) \times \left(\frac{V_M}{T_M \times (k+1)} \times t - V_{f0}\right), \text{ and}$$

$$T_k = \frac{V_{Lm} \times (k+1)}{V_M} \times T_M,$$

the total current flowing through the LED is:

$$\int_{T_{k-1}}^{T_k} I_{LED(1,k)} dt = \frac{(k+1)\times T_M}{2\times V_M}\times I_{Lm}\times(V_{Lm}-V_{f0}) \text{ if}$$

$$V_{f0} \geq \frac{k}{k+1} V_{Lm}, \text{ and}$$

$$\int_{T_{k-1}}^{T_k} I_{LED(1,k)} dt = \frac{T_M}{V_M}\times I_{Lm}\times\left[V_{Lm}-\frac{V_{Lm}^2}{2\times(k+1)\times(V_{Lm}-V_{f0})}\right]$$

$$\text{if } V_{f0} < \frac{k}{k+1} V_{Lm}.$$

Figure 13:
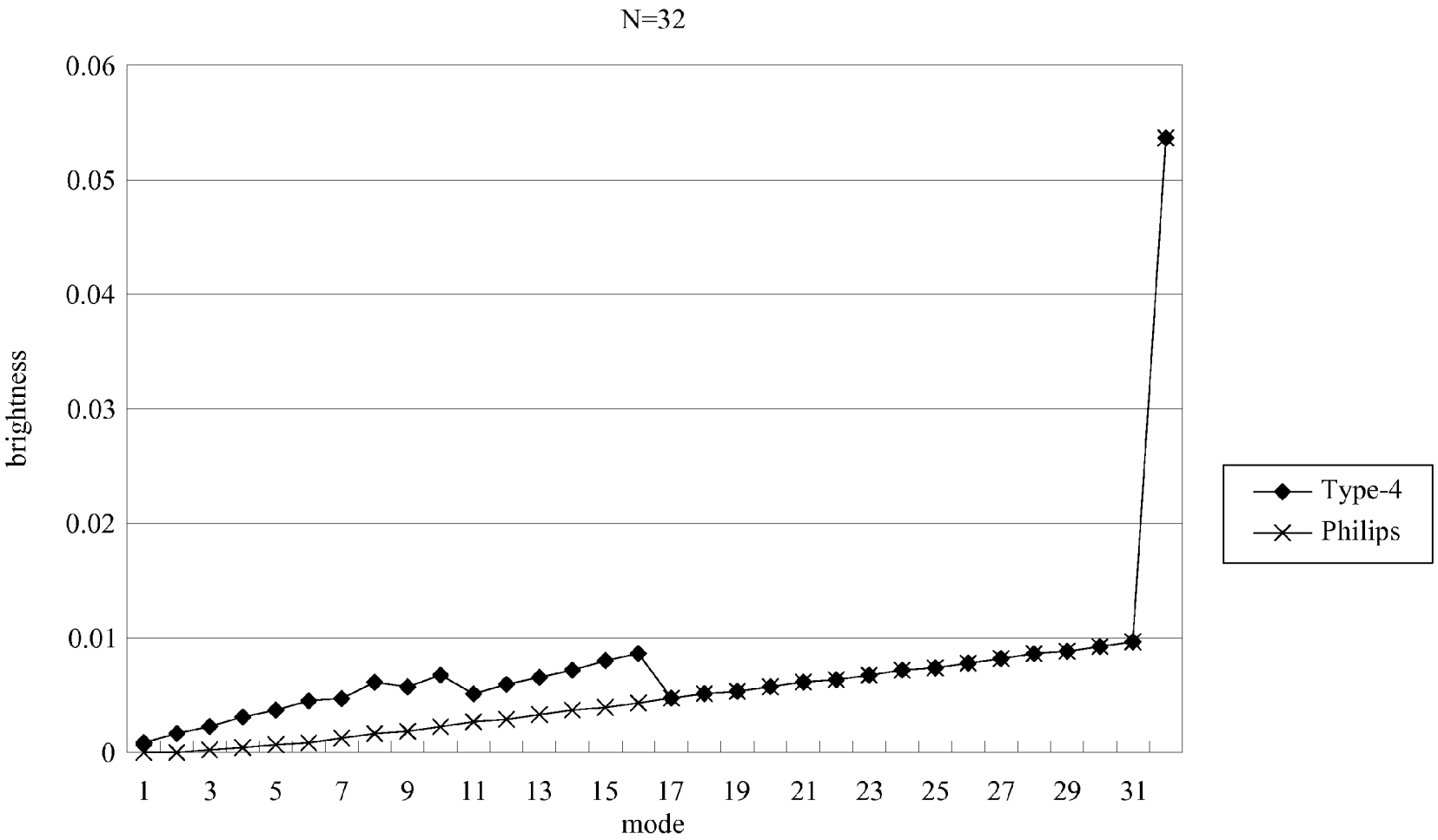
FIG. 13 shows a chart of brightness comparison by comparing the brightness achieved by the fourth driving method provided by the present invention with the brightness achieved by the driving method provided by Philips for 32 LED-based lighting units.

FIG. 13 shows a chart of comparing the brightness achieved using the fourth driving method provided by the present invention with the driving method provided by Philips for the LED-based lighting units that comprise 32 LEDs with 32 different lighting modes. In the comparison, the LEDs are assumed to be Cree LEDs and input voltage $V_{IN}$ is 120 volt with 60 Hz. It can be seen from FIG. 13 that the fourth driving method of this invention results in more brightness for the LED-based lighting units in many lighting modes.

Figure 14:
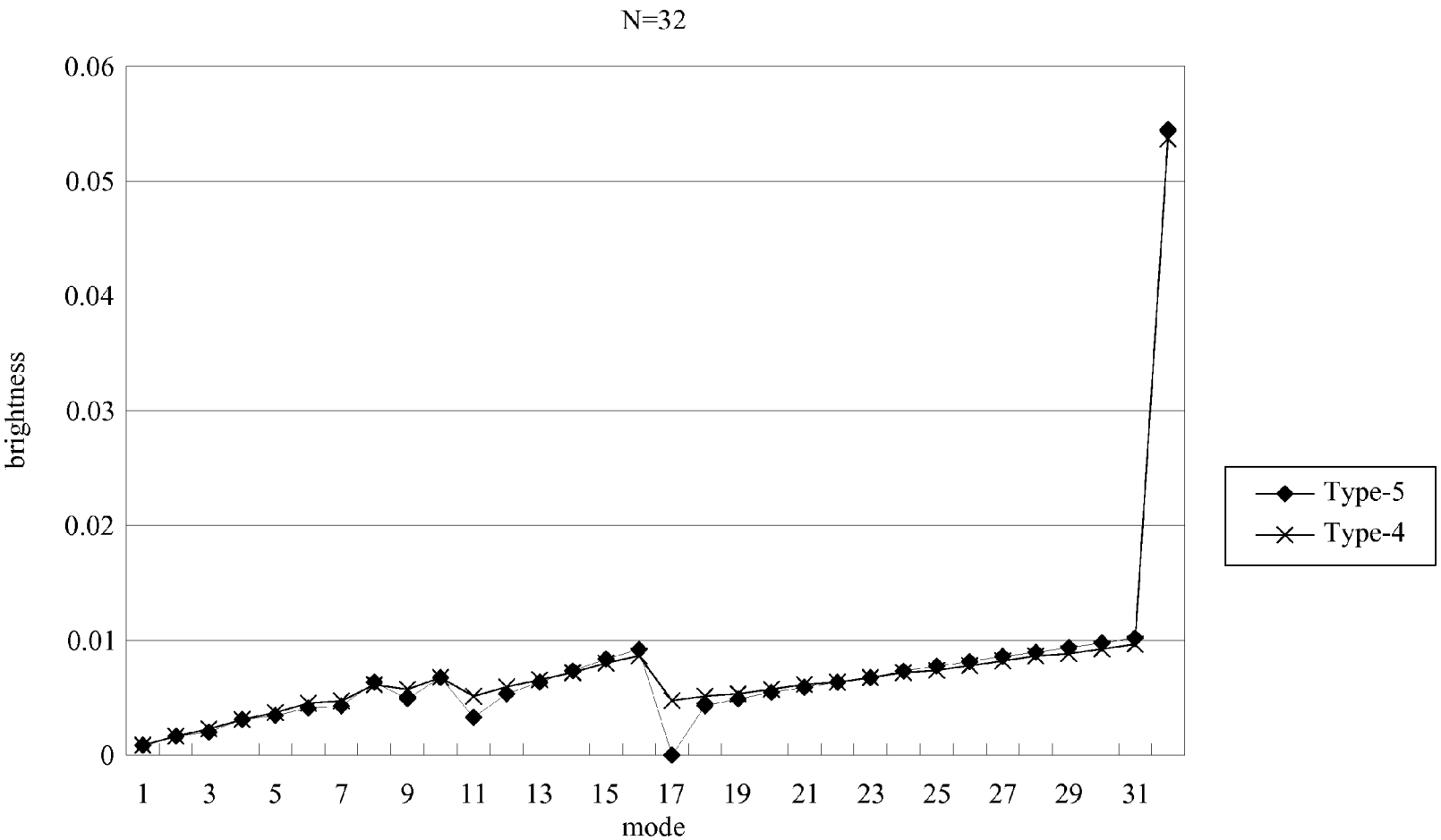
FIG. 14 shows another chart of brightness comparison by comparing the brightness achieved by the fourth driving method with the brightness achieved by the fifth driving method provided by the present invention for the same LED-based lighting units.

FIG. 14 shows another chart of comparing the brightness achieved using the fourth and fifth driving methods provided by the present invention for the same LED-based lighting units. It can be seen that the two driving methods are very compatible with the fourth driving method provides slightly more brightness for the LED-based lighting units in some lighting modes.

Figure 15:
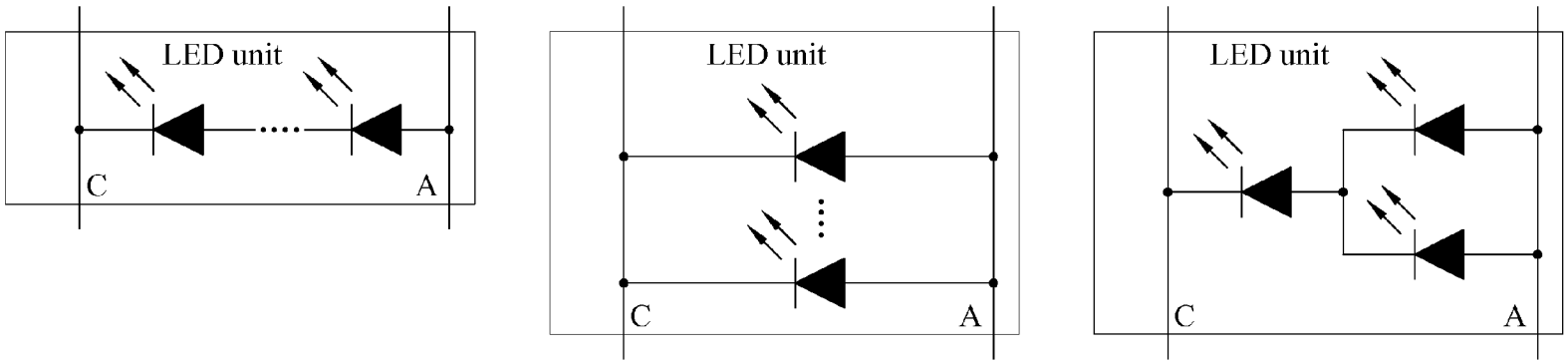
FIG. 15 illustrates that each of the LED-based lighting unit may have at least one LED connected in series, parallel or their combination.

In summary, the present invention provides an apparatus for controlling and connecting a plurality of LED-based lighting units in which some can be connected in series and some can be connected in parallel. Each lighting unit may include one or more LEDs connected in series, parallel or their combination as shown in FIG. 15. Although only three examples are shown in FIG. 15, it should be noted that the LEDs can be connected in many different ways to serve as a lighting unit of the present invention. By using the driving methods of the invention, multiple lighting modes can be provided for the LED-based lighting units. The present invention may increase the utilization of LEDs as can be seen from the brightness comparison chart shown in FIG. 13. Many different lighting modes can be provided for various requirements. In addition, by using an appropriate driving method, the current flowing through the LEDs of the lighting units can be controlled to be more uniform.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. An apparatus for driving LED-based lighting units, comprising:

a plurality of LED-based lighting units, each of said LED-based lighting units having a positive terminal, a negative terminal and one or more LEDs connected between said positive and negative terminals;

a plurality of switching units interleaved with said plurality of LED-based lighting units, each of said switching units being disposed between a corresponding leading LED-based lighting unit and a corresponding trailing LED-based lighting unit;

an input voltage supply connected to said positive terminal of a first LED-based lighting unit of said plurality of LED-based lighting units;

a controller for controlling said plurality of switching units; and a current control device having a first end connected to said negative terminal of a last LED-based lighting unit of said plurality of LED-based lighting units, and a second end connected to ground;

wherein each of said plurality of switching units is separately controlled by said controller and comprises a series-connection mode for connecting said negative terminal of said corresponding leading LED-based lighting unit to said positive terminal of said corresponding trailing LED-based lighting unit, a parallel-connection mode for connecting the two positive terminals of the corresponding leading and trailing LED-based lighting units together, and the two negative terminals of the corresponding leading and trailing LED-based lighting units together, and a by-pass mode for connecting both said positive terminal and said negative terminal of said corresponding leading LED-based lighting unit to said positive terminal of said corresponding trailing LED-based lighting unit.

2. The apparatus as claimed in claim 1, wherein each of said plurality of switching units comprises a first parallel-connection switch for connecting the two positive terminals of the corresponding leading and trailing LED-based lighting units, a second parallel-connection switch for connecting the two negative terminals of the corresponding leading and trailing LED-based lighting units, and a series-connection switch for connecting said negative terminal of said corresponding leading LED-based lighting unit to said positive terminal of said corresponding trailing LED-based lighting unit.

3. The apparatus as claimed in claim 1, wherein said first end of said current control device sends a voltage level to said controller and said controller controls said plurality of switching units to operate in different modes according to said voltage level.

4. The apparatus as claimed in claim 3, wherein said controller controls said plurality of switching units to operate in different modes according to a voltage level of said input voltage supply and said voltage level sent by said first end of said current control device.

5. The apparatus as claimed in claim 1, wherein said current control device is a current sensing resistor.

6. The apparatus as claimed in claim 1, wherein said current control device is a variable current source.

7. The apparatus as claimed in claim 1, wherein each of said plurality of LED-based lighting units comprises one or more LEDs connected in series between said positive and negative terminals.

8. The apparatus as claimed in claim 1, wherein each of said plurality of LED-based lighting units comprises a plurality of LEDs connected in parallel between said positive and negative terminals.

9. The apparatus as claimed in claim 1, wherein each of said plurality of LED-based lighting units comprises a plurality of LEDs connected in a combination of parallel and series connections between said positive and negative terminals.

10. The apparatus as claimed in claim 1, wherein said controller controls said plurality of switching units to operate in different modes according to a voltage level of said input voltage supply.

11. The apparatus as claimed in claim 10, wherein all of said plurality of switching units are controlled to operate in said series-connection mode when said input voltage supply has a maximum voltage level and operate in said parallel-connection mode when said input voltage supply has a minimum voltage level, and some of said plurality of switching units are controlled to operate in said series-connection mode and some of said plurality of switching units are controlled to operate in said parallel-connection mode when the voltage level of said input voltage supply varies between said maximum voltage level and said minimum voltage level.

12. The apparatus as claimed in claim 11, wherein the number of switching units controlled to operate in said parallel-connection mode increases as the voltage level of said input voltage supply decreases from said maximum voltage level to said minimum voltage level.

13. The apparatus as claimed in claim 11, wherein the apparatus comprises N LED-based lighting units and (M+1) different lighting modes, where $N=2^M$ and in lighting mode k for k=0, 1, 2, . . . , M, there are $2^k$ groups of LED-based lighting units connected in series with each group comprising $(N/2^k)$ LED-based lighting units connected in parallel.

14. The apparatus as claimed in claim 11, wherein the apparatus comprises N LED-based lighting units and N different lighting modes, and in lighting mode k for k=0, 2, . . . , N−1, there are k LED-based lighting units connected in series with a group of LED-based lighting units formed by the remaining (N-k) LED-based lighting units connected in parallel.

15. The apparatus as claimed in claim 11, wherein the apparatus comprises N LED-based lighting units and (M+1) different lighting modes, where integers $n_0, n_1, \ldots, n_M$ are dividers in increasing order for N with $N/n_k$ being an integer number, and in lighting mode k for k=0, 1, 2, . . . , M, there are $n_k$ groups of LED-based lighting units connected in series with each group comprising $(N/n_k)$ LED-based lighting units connected in parallel.

16. The apparatus as claimed in claim 11, wherein the apparatus comprises N LED-based lighting units and N lighting modes, and in lighting mode k for k=0, 1, 2, . . . , N−1, there are (k+1) groups of LED-based lighting units connected in series with each group comprising $$\left\lfloor \frac{N}{k+1} \right\rfloor$$

LED-based lighting units connected in parallel, and the remaining $$\left(N-(k+1)\times\left\lfloor \frac{N}{k+1} \right\rfloor\right)$$

LED-based lighting units are bypassed, where $$\left\lfloor \frac{N}{k+1} \right\rfloor$$

represents an integer part of N/(k+1).

17. The apparatus as claimed in claim 11, wherein the apparatus comprises N LED-based lighting units and N lighting modes, and in lighting mode k for k=0, 1, 2, . . . , N−1, all the LED-based lighting units are divided into (k+1) groups of LED-based lighting units connected in series in which $A_k$ of the groups each comprise $$\left\lfloor \frac{N}{k+1} \right\rfloor$$

LED-based lighting units connected in parallel, and $B_k$ of the groups each comprise $$\left(\left\lfloor \frac{N}{k+1} \right\rfloor+1\right)$$

LED-based lighting units connected in parallel, wherein $$\left\lfloor \frac{N}{k+1} \right\rfloor$$

represents an integer part of N/(k+1) and $A_k+B_k=(k+1)$.

* * * * *